US007880633B2

(12) United States Patent
Thum

(10) Patent No.: US 7,880,633 B2
(45) Date of Patent: Feb. 1, 2011

(54) DEVICE AND METHOD FOR MONITORING THE POSITION OF A CABLE IN A CABLE OPERATED TRANSPORTATION SYSTEM AND A CABLE OPERATED TRANSPORTATION SYSTEM

(75) Inventor: Richard Thum, Kornwestheim (DE)

(73) Assignee: HIMA Paul Hildebrandt GmbH + Co KG, Bruehl (DE)

( * ) Notice: Subject to any disclaimer, the term of this patent is extended or adjusted under 35 U.S.C. 154(b) by 484 days.

(21) Appl. No.: 12/009,596

(22) Filed: Jan. 17, 2008

(65) Prior Publication Data

US 2008/0208519 A1 Aug. 28, 2008

(30) Foreign Application Priority Data

Jan. 30, 2007 (DE) ..... 10 2007 006 316

(51) Int. Cl.

| | |
|---|---|
| ***G08B 21/00*** | (2006.01) |
| ***G05B 23/02*** | (2006.01) |
| ***B66C 13/16*** | (2006.01) |
| ***B66C 13/18*** | (2006.01) |
| ***B66C 15/06*** | (2006.01) |
| ***B66C 23/88*** | (2006.01) |

(52) U.S. Cl. ..... 340/686.2; 340/3.43; 212/276

(58) Field of Classification Search ..... 340/686.1, 340/686.2, 686.3, 3.43, 3.44, 505–507, 687; 324/207.11–207.2; 702/150; 212/167, 316, 212/276; 200/61.18

See application file for complete search history.

(56) References Cited

U.S. PATENT DOCUMENTS

| | | | | |
|---|---|---|---|---|
| 4,003,314 | A * | 1/1977 | Pearson | 104/307 |
| 4,019,002 | A * | 4/1977 | Kunczynski | 200/61.18 |
| 4,341,257 | A * | 7/1982 | Scheurecker et al. | 164/150.1 |
| 4,363,945 | A * | 12/1982 | Kunczynski | 200/61.18 |
| 4,671,187 | A * | 6/1987 | Kunczynski | 104/179 |
| 5,201,272 | A * | 4/1993 | Simon | 101/485 |
| 5,528,219 | A | 6/1996 | Frohlich et al. | 340/540 |
| 5,581,180 | A | 12/1996 | Ito et al. | 324/207.11 |
| 5,721,533 | A * | 2/1998 | Smith | 340/686.1 |
| 5,959,272 | A * | 9/1999 | Marchitto | 200/61.42 |
| 5,977,662 | A | 11/1999 | Lamarche et al. | 307/125 |
| 6,356,202 | B1 | 3/2002 | Albrich et al. | 340/686.2 |
| 7,432,703 | B2 * | 10/2008 | Heimlicher et al. | 324/207.16 |

FOREIGN PATENT DOCUMENTS

| | | |
|---|---|---|
| DE | 196 20 065 | 11/1997 |
| DE | 197 52 362 | 6/1999 |
| EP | 1 038 354 | 9/2003 |

* cited by examiner

*Primary Examiner*—Jennifer Mehmood
(74) *Attorney, Agent, or Firm*—Lipsitz & McAllister, LLC

(57) ABSTRACT

A cable position monitoring device is provided, for monitoring the position of a cable guided in the rollers of a roller assembly of a cable operated transportation system comprising at least one first and at least one second cable roller defining a reference roller, the cable position monitoring device comprising a movement-magnitude detecting device for determining a first movement-magnitude of the at least one first cable roller and a second movement-magnitude of the reference roller, and an evaluating device for comparing the first and second movement-magnitudes and for determining a mutual movement-magnitude deviation between the first and second movement-magnitudes which corresponds to a safe-to-operate status of the transportation system. An improved cable operated transportation system as well as a method for monitoring the position of a cable of a cable operated transportation system are also provided.

55 Claims, 9 Drawing Sheets

44
12
42
32
50
68
22
54
CONVERTER 74
22
CONVERTER
74
EVALUATING
70 DEVICE
50
32
46
54
68
18
50
74
CONVERTER
10
22
54
68
22
50
74
CONVERTER
40
52
48
SIGNAL
PRODUCTION
DEVICE
82
80 COMPARISON
SCALE
CONTROL
72 POST
REGULATION
90 DEVICE
16
70
EVALUATING
DEVICE
78
MEMORY
DRIVE
DEVICE
76
STATUS
DETERMINING
DEVICE
ALARM
DEVICE 86
88
ALARM
SIGNAL
INDICATOR
DEVICE
84
INDICATOR
DEVICE
92 POSITION
DETECTING
DEVICE

DEVICE AND METHOD FOR MONITORING THE POSITION OF A CABLE IN A CABLE OPERATED TRANSPORTATION SYSTEM AND A CABLE OPERATED TRANSPORTATION SYSTEM

The present disclosure relates to the subject matter disclosed in German patent application 10 2007 006 316.6 which is incorporated herein by reference in its entirety and for all purposes.

BACKGROUND OF THE INVENTION

The present invention relates to a cable-position monitoring device for monitoring the position of a cable, which is guided in the rollers of a roller assembly, in at least one first cable roller that is to be monitored in the roller assembly of a cable operated transportation system comprising the at least one first and at least one second cable roller defining a reference roller.

Furthermore, the present invention relates to a cable operated transportation system incorporating a cable, a drive device for moving the cable and at least one roller assembly for guiding the cable, wherein the at least one roller assembly comprises at least one first cable roller and at least one second cable roller defining a reference roller, wherein furthermore, there is provided a cable position monitoring device for monitoring at least the position of the cable guided in the at least one first cable roller.

Moreover, the present invention relates to a method for monitoring the position of a cable, which is guided in the rollers of a roller assembly, in at least one first cable roller that is to be monitored in a roller assembly of a cable operated transportation system comprising the at least one first and at least one second cable roller defining a reference roller.

In cable operated transportation systems, aerial cableways in the form of chair lifts or gondola cars for example, the carrier-, traction- and/or hoisting cables of the transportation system are guided over cable rollers. As a rule, the cable rollers are arranged on supports in the landscape, whereby a plurality of cable rollers together can form a roller assembly. The cable rollers of the transportation system serve either as supporting rollers upon which the cable rests, or as hold-down rollers which hold the cable down, i.e. the cable is guided under the cable rollers. In none of these cases however is the cable guided over its full extent. As a consequence thereof, the cable can jump off the cable rollers in certain conditions, due to the transverse forces arising as a result of wind or jolting movements for example. In such a case, the cable is moved parallel to an axis of rotation of the cable roller and can escape from a guide slot in the cable roller.

For the purposes of safeguarding the transportation system, so-called cable grabbers are usually arranged on the supports carrying the cable rollers which catch the cable after it is dislodged from one or more of the rollers. Operation of the transportation system is interrupted conventionally by the release of a break-bar switch which is actuated by the dislodged cable. Thus, the position of the cable can only be detected in two positions in the manner described. Either the cable is being guided in the cable roller or the cable rollers, or it is already dislodged. Clear guidance as to whether there is or is not a threat of the danger of a cable becoming dislodged cannot be established in the manner described.

A circuit arrangement for monitoring the fault free state and/or for detecting a faulty state, in particular for monitoring the position of the cable in an aerial cableway or chair lift system, is disclosed in DE 197 52 362 A1. In this disclosure, it is proposed in particular that the position of the cable be monitored by means of inductive or capacitive proximity switches. This, however, has the disadvantage that it is necessary for the proximity switches to be installed in a very precise manner in order to enable reliable information in regard to the state of the system to be given. Furthermore, the use of proximity switches has the disadvantage that the positioning of the proximity switches has to be altered as the period of operation of the transportation system increases due to wear of the cable rollers.

Consequently, it would be desirable to improve a cable position monitoring device, a cable operated transportation system and a method of monitoring the cable position of a cable operated transportation system of the type described hereinabove in such a way that a threatening cable-dislodgement of the cable from at least one cable roller of the transportation system can be recognized in a simple manner.

SUMMARY OF THE INVENTION

In accordance with the invention, it is suggested in the case of a cable position monitoring device of the type described hereinabove that a movement-magnitude detecting device is provided for determining a first movement-magnitude of the at least one first cable roller and a second movement-magnitude of the reference roller, and that an evaluating device is provided for comparing the first and second movement-magnitudes and for determining a mutual movement-magnitude deviation between the first and second movement-magnitudes which corresponds to the safe-to-operate status of the transportation system.

With the aid of a cable position monitoring device of this type, it can be determined in a simple and certain manner as to whether and how far the cable of the transportation system has moved from a rest position taken with reference to the at least one first cable roller relative thereto. Preferably, a run-in or a run-out roller of a roller assembly is selected as the first roller, and a cable roller which is arranged between two neighbouring cable rollers as the reference roller. Namely, a transverse force effective on the cable in the case of the at least one first roller typically leads to a larger deflection of the cable from the rest position than is the case for the reference roller.

However, in a conventional cable roller, the consequence of a deflection of the cable from the rest position is that the cable no longer touches the at least one first roller at the deepest point of the guide slot, but rather, at a raised edge or a flank thereof. If, however, the cable is guided at a constant speed over both the at least one first roller and the reference roller, then the effective radii of the at least one first roller and the reference roller differ from each other due to the deflection of the cable. This then leads to the at least one first roller, which typically has a larger effective radius and relative to which the cable is deflected from its rest position to a greater extent than the reference roller, having a reduced rotational speed compared with that of the reference roller. The rotational speed is, however, a first movement-magnitude of the at least one first cable roller and can be compared with a rotational speed of the reference roller defining a second movement-magnitude. Thus, a mutual movement-magnitude deviation between the first movement-magnitude determined by the movement-magnitude detecting device and the second movement-magnitude can be determined in a simple manner with the aid of the evaluating device. The larger the mutual deviation of the first and second movement-magnitudes, the greater the danger of a cable becoming dislodged. A value of the movement-magnitude deviation therefore correlates directly to the safe-to-operate status of the transportation system. The larger the movement-magnitude deviation, so the more uncertain is the safe-to-operate status of the transportation system. Thus, by virtue of the cable position monitoring device proposed in accordance with the invention, a cable position of the transportation system can be monitored at one or more cable rollers in a simple manner merely by determining the movement-magnitudes of two cable rollers. Furthermore, changes in the position of a cable can be detected in a simple and certain manner and so, in particular, a threatening danger of a cable dislodgement can be reacted to before the cable is actually dislodged. A complicated adjustment of the movement-magnitude detecting device, as is the case for the circuit arrangement known from DE 197 52 362 A1, is not necessary with the present invention. Namely, the position of the cable is not determined directly, but rather an alteration in the position of the cable is determined indirectly from the effect of the change of the cable position on the respective movement-magnitudes of the monitored cable rollers. In addition, the proposed cable position monitoring device is completely independent of the type and form of the cable. The structure of the cable, which can have an effect on the result of the measurement in the case of a direct monitoring process by means of proximity sensors for example, is of no importance for the present invention. In addition, the cable position monitoring device in accordance with the present invention is also suitable for determining the wear on the monitored rollers. As the period of operation of the system increases, the cable rollers wear out and this leads to a change in the magnitudes of the movements at the monitored cable rollers when the cable is driven at a constant speed. Thus, the state of wear within roller assemblies or even, between different roller assemblies can be determined. This has the advantage that the cable rollers of the transportation system need only actually be maintained or replaced when the wear on the monitored cable roller exceeds a certain predetermined amount. Furthermore, the device proposed in accordance with the invention has the advantage that discontinuities in the movement of the cable do not play a part in the process of determining the safeness status of the transportation system. For example, the dip in the span of the cable between two roller assemblies can alter in load dependent manner. In particular, the speed components caused by fluctuations in the load and varying cable accelerations are compensated by the determination of the movement-magnitude deviation.

It is expedient for the safe-to-operate status determining device to be provided for determining the safe-to-operate status of the transportation system in dependence on at least one specific movement-magnitude deviation. The safe-to-operate status determining device makes it possible to determine the safe-to-operate status of the transportation system in dependence on a determined or a specific movement-magnitude deviation. Thus, for example, it is possible in dependence on the specific movement-magnitude deviation to indicate the safe-to-operate status of the transportation system, for example, "ready for use" or "danger of a cable dislodgement" or "danger of cable dislodgement at roller assembly No. . . . ".

Advantageously, a cable position detecting device is provided for determining the position of a cable in the at least one first cable roller. For example, the safe-to-operate status of the transportation system can also be determined by determining the position of the cable in the at least one first cable roller. Furthermore, it is also conceivable to indicate the position of the cable in the at least one first cable roller or in a guide slot thereof taken with reference to a rest position in which no transverse forces are effective on the cable.

Preferably, the cable position detecting device is configured in such a manner that a deflection of the cable in the at least one first cable roller from the rest position in which no transverse forces are effective on the cable is determinable from the detected movement-magnitude deviation. It can then be indicated directly as to how far the cable is deflected from the rest position, for example, if it has been pressed laterally away from the axis of rotation of the cable roller in parallel therewith from a deepest point of the slot onto a roller flank of the guide slot.

In accordance with a preferred embodiment of the invention, provision may be made for the safe-to-operate status determining device to be configured in such a manner that the safe-to-operate status of the transportation system is associable with the position of the cable in the at least one first cable roller that was determined by the cable position detecting device. The safe-to-operate status of the transportation system can likewise be determined and indicated in this way when the position of the cable has been determined by the cable position detecting device.

Advantageously, the evaluating device is configured in such a manner that a movement-magnitude deviation for at least two first cable rollers is determinable by comparison of the first movement-magnitudes of the at least two first cable rollers and the second movement-magnitude of the reference roller. Due to the determination of a movement-magnitude deviation for at least two first cable rollers, the threatening danger of a cable dislodgement can be predicted in improved manner and with more certainty. In particular, the two first cable rollers can be arranged in the same roller assembly, although they could also be first cable rollers of different roller assemblies. Thus, in the case of a transportation system which comprises a plurality of roller assemblies and not just one roller assembly, the latter variant makes it possible to monitor not just one roller assembly in regard to the danger of a possible cable dislodgement but several or even all of them. Furthermore, this can also enable a certain redundancy or plausibility check to be made during the determination of the safe-to-operate status of the transportation system. Thus, in particular, the wear on the rollers can also be determined more precisely when two or more first cable rollers are being monitored in the manner described.

It is expedient for a comparison scale for the safe-to-operate status to be provided, and for the safe-to-operate status signal production device to be provided for producing the safe-to-operate status signal which corresponds to a value of the safe-to-operate status on the comparison scale that is assigned to the determined movement-magnitude deviation. The comparison scale for the safe-to-operate status can indicate, in particular, how the transportation system has been set up in regard to its safeness to operate. It can comprise an indication of from 0% to 100% or, for example, a scale of school examination marks from 1 to 6. However, various safe-to-operate statuses can also be explicitly indicated, such as for example, "working perfectly", "low risk", "increased risk" or "very high risk" of a cable dislodgement. With the aid of the safe-to-operate status signal production device and on the basis of the determined movement-magnitude deviation, there can be produced, in particular, the safe-to-operate status signal which then indicates the value that the current safe-to-operate status of the transportation system has adopted from a consideration of the comparison scale.

It is advantageous, if a comparison scale for the safe-to-operate status is provided, and if the safe-to-operate status signal production device is provided for producing the safe-to-operate status signal which corresponds to a value of the safe-to-operate status on the comparison scale that is assigned to a deflection of the cable in the at least one first cable roller from the rest position. With the aid of such a safe-to-operate status signal production device, a safe-to-operate status signal can be produced which has a value for the safe-to-operate status in correspondence with the comparison scale so that the safe-to-operate status signal can be indirectly determined and indicated from the deflection of the cable in the at least one first cable roller from the rest position.

It is advantageous, if the safe-to-operate status signal production device is configured in such a manner that certain movement-magnitude deviations from at least two first cable rollers are processable for the production of the safe-to-operate status signal. Such a safe-to-operate status signal production device allows two or more first cable rollers to be monitored and the danger of a possible cable dislodgement from these cable rollers to be processed. Hereby, this can relate to the first cable rollers of a single roller assembly or else of several roller assemblies. In particular, it is also conceivable to monitor all the roller assemblies of the transportation system i.e. at least a first cable roller per roller assembly.

It is expedient for the safe-to-operate status signal production device to comprise a maximum value determination unit with which a maximum value of at least two movement-magnitude deviations is determinable. With the aid of the maximum value determination unit, it is possible, in particular, to evaluate which of the two or more movement-magnitude deviations obtained from two or more first rollers is the largest. Preferably, the thus obtained maximum value of the largest movement-magnitude deviation determines the safe-to-operate status of the entire transportation system. Furthermore, it can thus also be established as to at which first roller or at which roller assembly of the transportation system there is currently the greatest danger of a cable dislodgement.

In order to enable the service personnel of the transportation system to monitor the safe-to-operate status of the transportation system in a simple and secure manner, it is advantageous if an optical and/or acoustic indicator device is provided for indicating the safe-to-operate status signal. The indicator device may, for example, comprise a colour scale for indicating the safe-to-operate status, for example, from red to green. Self-evidently, there could also be provided a screen which displays the safe-to-operate status of the transportation system in full text, by symbols or by coloured representations. An acoustic indicator device in the form of loudspeakers can be provided for example, and preferably thereby, an acoustic signal is produced if the safe-to-operate status reaches a value that is critical for the operation of the transportation system. In particular, the indicator device can also be part of a mobile signalling device. For example, a mobile telephone which can indicate the safe-to-operate status signal optically and/or acoustically is suitable as a mobile indicator device. Preferably, a vibration alarm can also be used in order to indicate the safe-to-operate status signal to an operative. Optionally, the transmission of the safe-to-operate status signal over an electronic short messaging system to a mobile telephone, for example, a so-called SMS or else an E-Mail would also be possible.

Advantageously, there is provided an alarm device for producing an alarm and/or a shut-down signal if a value of the safe-to-operate status signal exceeds a given limiting value. For example, the alarm device can be comprised by the evaluating device or the safe-to-operate status determining device. The produced alarm and/or shut-down signal can be indicated or be used for automatically reducing a drive speed of the transportation system or for switching the latter off, for example, in that it is passed to a control and/or regulation device of the transportation system for further processing.

In order for an operative to recognize an alarm state conveyed by the alarm device, it is expedient for an optical and/or acoustic alarm signal indicator device to be provided for indicating the alarm and/or the shut-down signal. For example, in like manner to the indicator device, the alarm signal indicator device can be arranged for indicating the safe-to-operate status signal in a control post of the transportation system or in places at which an operative can gain access to the control and/or regulation system of the transportation system.

It is expedient for the alarm device to cooperate with a control and/or regulation device of a drive device of the transportation system and be configured in such a manner that a drive speed of the transportation system can be reduced and/or the drive device of the transportation system can be disconnected as a result of the production of an alarm and/or of a shut-down signal. The alarm device configured in such a manner permits automatic intervention in the operation of the transportation system i.e. it is not necessary for an operative to recognize the determined alarm state and then take action in regard to the operation of the transportation system. Rathermore, a decrease of the drive speed of the transportation system or the shut-down thereof can take place automatically if the danger of a cable dislodgement threatens.

It is expedient for the movement-magnitude detecting device to be configured in such a manner that the first and second movement-magnitudes are determinable at the same time. Thus, for example, the movement-magnitude deviation can be determined by the evaluating device at practically the same time as that for the determination of the movement-magnitudes so that the safe-to-operate status of the transportation system and concomitantly the danger of a threatening cable dislodgement are adapted to be given at practically the same time and thus in real time.

In order to enable possible fluctuations to be compensated during the detection of the movement-magnitudes, it is expedient for the movement-magnitude detecting device to be configured in such a manner that the first and second movement-magnitudes are determinable in time dependent manner, and for the evaluating device to be configured in such a manner that an average deviation of the first movement-magnitude from the second movement-magnitude is determinable over a given time interval. Thus, in particular, unnecessary shutting down of the transportation system or an unnecessary reduction of its speed can be prevented in the event of just small fluctuations of the movement-magnitude deviation which correspond to a critical operational state. The time interval can in principle be of arbitrary length. For example, it would be conceivable to utilise a time interval in a range of from 0.5 sec to 5 sec, to determine an average movement-magnitude deviation over this time interval and then to determine the safe-to-operate status of the transportation system on the basis of the determined average movement-magnitude deviation.

In order to minimize the wear on the movement-magnitude detecting device, it is expedient for it to be configured such that the first and/or second movement-magnitude is determined in non-contact making manner.

The construction of the movement-magnitude detecting device is simplified in particular, if it is in the form of a rotational speed or an angular speed detecting device. The rotational speed or the angular speed of the at least one first cable roller as well as that of the reference roller can thereby be determined in a simple manner. Differences of rotational speed or angular speed differences between the at least one first cable roller and the reference roller can then be determined in a simple manner by the evaluating device, and a movement-magnitude deviation which in turn serves as a basis for the indication of the safe-to-operate status of the transportation system can thus be provided.

A particularly simple form of construction for the rotational speed or the angular speed detecting device can be obtained if it comprises a clock pulse generating member which is connectable in mutually non-rotational manner to the cable roller the movement-magnitude of which is to be determined, and at least one sensor for detecting a rotation of the clock pulse generating member. In particular, a rotation of the clock pulse generating member can thereby be detected in non-contact making manner by a sensor which can, in particular, be in the form of an inductive or capacitive proximity switch.

It is expedient for the clock pulse generating member to be in the form of a timing disc having a plurality of clock members arranged regularly around the periphery of the timing disc. A movement of the clock members relative to the sensor can then be determined in a simple manner. For example, the clock members can be in the form of magnets. In order to obtain good resolution in addition thereto, it is expedient if several clock members are provided per unit angle. In consequence, a movement-magnitude of the at least one first cable roller or the reference roller can be determined even if the respective roller has still not carried out a full revolution.

A particularly simple form of construction of the timing disc results, if the clock members are in the form of radially outwardly or axially protruding projections which form a regular tooth-set.

In order to enable a movement of the clock pulse generating member to be detected in a particularly simple manner and in particular by capacitive or inductive proximity switches, it is expedient for the clock pulse generating member to be made at least partly of a metal. Preferably, the clock members are made of a metal.

Preferably, the clock pulse generating member is provided with an anti-icing layer. This thus prevents the clock pulse generating member from becoming iced up and thereby damaging a sensor disposed at a certain distance from the clock pulse generating member by virtue of an icy layer that has configured thereon.

It is particularly expedient in the production process and in addition thereto, efficient in the effect thereof, to provide an anti-icing layer which is made of a synthetic material.

Preferably, the sensor is an inductive or capacitive proximity sensor. A movement-magnitude of a cable roller can be detected in a simple and certain manner and, in addition, in non-contact making manner with a sensor of this type.

In accordance with a preferred embodiment of the invention, provision may be made for the movement-magnitude detecting device to be configured in such a manner that a movement-magnitude of a run-in roller and/or of a run-out roller of the roller assembly, which forms the at least one first cable roller, is determinable. The threat of a cable dislodgement in a roller assembly appears firstly at a run-in roller or a run-out roller thereof, since transverse forces which are effective on the cable can be least well absorbed by these rollers. In consequence, the safe-to-operate status of the transportation system can be determined most precisely at the run-in rollers or the run-out rollers of the roller assembly by a measurement of their movement-magnitudes in comparison with the movement-magnitude of a reference roller.

It is expedient for the movement-magnitude detecting device to be configured in such a manner that a movement-magnitude of an inner cable roller which is arranged between neighbouring cable rollers and forms the reference roller is determinable. An inner cable roller arranged between neighbouring cable rollers is particularly suitable as a reference roller since transverse forces that are effective on a cable have only the smallest effect on the position of the cable at the reference roller. As a consequence thereof, a position of the cable relative to such a reference roller barely changes or does not change at all, whereas the position of the cable on a run-in roller or a run-out roller can change significantly due to transverse forces effective on the cable. Due to the movement-magnitude deviation that is to be determined between the first movement-magnitude of the at least one first cable roller and the reference roller, the safe-to-operate status of the transportation system can then be determined in a secure and simple manner.

It is particularly advantageous to use one of the cable position monitoring devices described above for monitoring the position of a cable in the case of a transportation system in the form of an aerial cableway. By virtue of such a cable position monitoring device, the aerial cableway can be shut down, in particular, well before a cable dislodgement and thus in good time before an accident can occur, in the worst case with personal injuries.

It is expedient for the cable position monitoring devices described above to be used for monitoring the position of a carrier-, traction- and/or hoisting cable of a cable operated transportation system. The cable position monitoring devices are particularly suitable for monitoring the position of any type of cable which is moved for the operation of a cable operated transportation system.

Furthermore, it is advantageous if the cable position monitoring devices described above are used for monitoring the position of a cable that is guided by cable rollers which comprise a peripheral cable guide groove.

In accordance with the invention, it is also suggested in the case of a cable operated transportation system of the type described hereinabove that a movement-magnitude detecting device is provided for determining a first movement-magnitude of the at least one first cable roller and a second movement-magnitude of the reference roller, that an evaluating device is provided for comparing the first and second movement-magnitudes and for determining a mutual movement-magnitude deviation between the first and second movement-magnitudes which corresponds to the safe-to-operate status of the transportation system. A cable operated transportation system of this type meets the highest safety requirements, because it is then possible to operate the cable operated transportation system by the provision of the cable position monitoring device, in particular, one of the cable position monitoring devices such as were described above, in such a way that the danger of a cable dislodgement is recognized and intervention in the operation of the transportation system can accordingly be made, for example, by reducing the speed thereof or by shutting it down.

Preferably, the cable operated transportation system comprises one of the cable position monitoring devices described above. All of the above described advantages are then also realized in the transportation system as a whole.

Preferably the cable is a carrier-, a traction and/or a hoisting cable. The cable position monitoring device of the transportation system can thus be used for monitoring all the moved cables in the system which are subject to the danger of a cable dislodgement.

It is expedient for a plurality of roller assemblies to be provided and for a or a common cable position monitoring device to be respectively associated with at least two of the roller assemblies. The provision of a plurality of roller assemblies has the advantage that the moved cable of the transportation system is guided in a particularly positive and certain manner. In addition, the guidance process is improved, the more cable rollers per roller assembly there are provided. The cable position monitoring device can be individually configured in such a way that it is provided for one roller assembly, or, in all, a common cable position monitoring device is provided for two or more roller assemblies. In addition, the cable position monitoring devices described above have the advantage that even existing transportation systems are easily equippable therewith. For example, it is sufficient to provide two movement detecting devices per roller assembly, these detecting the first and second movement-magnitudes of the at least one first cable roller and the reference roller.

Moreover, in accordance with the invention, it is also suggested in the case of a method of the type described hereinabove that a first movement-magnitude of the at least one first cable roller and a second movement-magnitude of the reference roller is determined, that the first movement-magnitude of the at least one first cable roller and the second movement-magnitude of the reference roller are compared and a mutual movement-magnitude deviation between the first and the second movement-magnitudes which corresponds to the safe-to-operate status of the transportation system is determined. In principle however, it would also be conceivable to determine the first and second movement-magnitude at the at least one first cable roller and the reference roller, wherein the two cable rollers are not arranged in a common roller assembly, but rather, in different roller assemblies. In principle, two arbitrary cable rollers of the transportation system can be drawn upon in the manner described in order to determine a movement-magnitude deviation and to indicate the safe-to-operate status of the transportation system on the basis of the size of the movement-magnitude deviation. Typically, the larger the mutual movement-magnitude deviation between the first and the second movement-magnitudes, the more critical the safe-to-operate status.

It is expedient for a position of the cable in the at least one first cable roller to be derived from the determined movement-magnitude deviation, and for the safe-to-operate status of the transportation system to be associated with the position of the cable in the at least one first cable roller. If the position of the cable changes relative to the at least one first cable roller, then typically, the movement-magnitude thereof changes. This is therefore based on the fact that the cable is usually guided in a guide slot in the cable roller. If the cable is moved relative to the at least one first cable roller due to operative transverse forces, then it wanders laterally outwardly from a deepest position in the guide slot onto the flank of the slot and away from the axis of rotation of the cable roller, so that an effective radius of the first guide slot for the cable changes. The radius typically becomes larger due to a change of the cable position. If the cable is moved at a constant speed, then a rotational speed or an angular speed of the at least one first cable roller thereby changes. This becomes smaller due to the increased radius. In particular, when the geometry of the guide roller is known, a position of the cable can then be determined in a simple manner from the movement-magnitude deviation. In addition, the safe-to-operate status of the transportation system can be associated with the position of the cable in a simple manner.

It is expedient for a deflection of the cable in the at least one first cable roller from a rest position in which no transverse forces are effective on the cable to be determined from the determined movement-magnitude deviation. An absolute deflection of the cable with respect to the rest position can thereby be determined.

It is advantageous, if the movement-magnitude deviation is determined for at least two first cable rollers by comparing the first movement-magnitude of the at least two first cable rollers and the second movement-magnitude of the reference roller. A determination of the movement-magnitude deviation for at least two first cable rollers has the advantage, in particular, of being better for excluding errors in the measurement as a result of such redundancy.

Preferably, the movement-magnitude deviation is compared with a comparison scale for the safe-to-operate status and the safe-to-operate status signal corresponding to the movement-magnitude deviation is produced, said signal corresponding to an assigned value of operational safety on the comparison scale. The comparison scale can, in particular, be a comparison scale of the type described hereinabove. The operational status signal is suitable, in particular, for automatic further processing, i.e. it can be used by a control and/or regulation device of the transportation system for further processing.

Advantageously, the deflection of the cable in the at least one first cable roller from the rest position is compared with a comparison scale for the safe-to-operate status, and the safe-to-operate status signal corresponding to the movement-magnitude deviation is produced, said signal corresponding to an assigned value of the safe-to-operate status on the comparison scale. Thus, a decision in regard to the safe-to-operate status of the transportation system can be made in a simple manner from the deflection of the cable and this can then be indicated.

It is expedient for specific movement-magnitude deviations from at least two first cable rollers to be processed in the course of producing the safe-to-operate status signal. This has the advantage that possible measuring errors, which can occur in connection with the determination of the movement-magnitude deviation for a first cable roller, can then be left out of consideration. Furthermore, due to such a procedure, the overall operational safety of the transportation system is improved since the threat of a danger of cable dislodgement can be recognized at two or more places and the operation of the transportation system can be adapted thereto in good time.

It is advantageous if a value of the safe-to-operate status signal corresponds to the larger of the determined movement-magnitude deviations which is determined for at least two first cable rollers by comparing the first movement-magnitude of the at least two first cable rollers and the second movement-magnitude of the reference roller. Thus, the safe-to-operate status signal can be produced, wherein the safe-to-operate status of the transportation system is determined by the size of the determined movement-magnitude deviations. As a rule, the largest of the determined movement-magnitude deviations is connected with the safe-to-operate status wherein the greatest threat of the danger of a cable dislodgement is present.

In order for an operative to recognize in a simple and certain manner which safe-to-operate status the transportation system is actually in, it is expedient for the safe-to-operate status signal to be indicated optically and/or acoustically.

It is advantageous, if an alarm and/or a shut-down signal is produced if a value of the safe-to-operate status signal exceeds a given limiting value. By virtue of the automatic production of the alarm and/or shut-down signal, intervention in the operation of the transportation system can be effected in a simple manner, for example automatically by cooperating with a control and/or regulation device of the transportation system, or manually, in that an operative accesses the control and/or regulation device of the transportation system in correspondence with the alarm and/or shut-down signal.

So that an operative can immediately recognize the fact that a safe-to-operate status prevails with which an alarm and/or a shut-down signal is associated, it is advantageous, if the alarm and/or shut-down signal is indicated optically and/or acoustically.

In order to counteract the danger of a threatening cable dislodgement, it is advantageous, if a drive speed of the transportation system is reduced, or a drive device of the transportation system is switched off, or the transportation system is shut down as a consequence of the production of the alarm or shut-down signal.

In order to enable a movement-magnitude deviation to be determine instantaneously, it is expedient for the first and the second movement-magnitude to be determined at the same time. The movement-magnitude deviation, which is determined from the comparison of the first and the second movement-magnitudes, thus corresponds to a deviation of the movement-magnitudes from each other at the time point for the determination thereof.

In accordance with a preferred variant of the method in accordance with the invention, provision may be made for the first and the second movement-magnitudes to be determined in time dependent manner, and for an average movement-magnitude deviation of the first movement-magnitude from the second movement-magnitude to be determined over a given time interval. Possible fluctuations in the cable speed over a certain interval of time can be compensated with the aid of such an arrangement. Moreover, it is then possible to prevent the transportation system from being shut down without good cause in the case of non-permanently occurring movement-magnitude deviations.

In order to minimize the wear and tear on the transportation system and thus increase the service life thereof, it is expedient for the first and/or the second movement-magnitudes to be determined in non-contact making manner.

Advantageously, the first and/or second movement-magnitude is determined in the form of the rotational speed of the at least one first cable roller and/or the reference roller. The rotational speed of the cable rollers can be determined in a simple manner by means of a rotational speed sensor for example.

Preferably, the first and/or second movement-magnitude is determined in the form of the angular speed of the at least one first cable roller and/or the reference roller. The angular speed of the cable roller can also be determined in a simple manner with the aid of appropriate angular speed sensors.

It is expedient for the first and/or the second movement-magnitudes to be determined using a rotational speed or an angular speed detecting device. For example, the first and/or second operational magnitudes can then be determined in a simple manner with the aid of rotational speed or angular speed sensors.

Advantageously, a run-in roller and/or a run-out roller of the roller assembly which form the end cable rollers of the roller assembly are selected as the at least one first cable roller. As already described hereinabove, the effect of a transverse force on the cable can be seen most clearly at the run-in and/or run-out rollers of a roller assembly. In consequence, the danger of a cable dislodgement is also greatest at these rollers. Usually, the cable jumps off first at the run-in or run-out rollers. An end cable roller of the roller assembly is to be understood as meaning the first or the last cable roller of the roller assembly which delimits the span of the cable to a next roller assembly.

It is expedient for a cable roller which forms an inner cable roller that is arranged between two neighbouring cable rollers to be selected as the reference roller. Preferably, this is the cable roller arranged at the innermost point of a roller assembly. For example, in the case of a cable roller assembly comprising seven cable rollers, it is preferably the fourth, i.e. the middle cable roller, which is selected as the reference roller. The further away the reference roller is arranged in the roller assembly from the run-in or run-out rollers, the smaller the influence of a transverse force effective on the cable. Thus, a significant change in the safe-to-operate status can be determined in a particularly precise and certain manner if an inner cable roller is selected as the reference roller.

Preferably, the method for monitoring the position of a cable is used in a transportation system in the form of an aerial cableway. Thus, in particular, a threatening danger of an accident in connection with a possible dislodgement of the cable can thereby be reduced.

It is expedient for the method to be used for monitoring the position of a carrier-, traction- and hoisting cable of a transportation system. Since, in practice, each of the types of cable mentioned above can jump off the guide rollers, the method is particularly outstanding for monitoring a threatening dislodgement of the cable for each of the types of cable mentioned above.

The method can be applied in a particularly advantageous manner to cable rollers which have a peripheral cable guide groove. The cable guide groove which is also referred to as a guide slot serves for the lateral guidance of the cable. With the aid of the method, it can be established in a particularly simple manner as to when the cable is moved out of the cable guide groove by transverse forces effective thereon. If the cable slides up onto a lateral side wall of the groove and begins to move somewhat from the cable guide groove due to the occurrence of transverse forces, an effective radius of the cable rollers relative to the cable is altered, generally increased. The rotational speed of the cable roller driven by the cable thereby reduces for a constant cable speed. This alteration in the movement-magnitude can be determined and compared with a movement-magnitude obtained from a reference roller and the safe-to-operate status of the transportation system can be derived therefrom.

The method can be applied in a particularly expedient manner to a cable roller, the cable guide groove of which has a cross section defining a segment of a circular arc. Rollers of this type are particularly easy to manufacture and also ensure good guidance of the cable in the presence of transverse forces effective on the cable.

The following description of preferred embodiments of the invention taken in conjunction with the drawing serves for a more detailed explanation thereof.

DETAILED DESCRIPTION OF THE INVENTION

Figure 1:
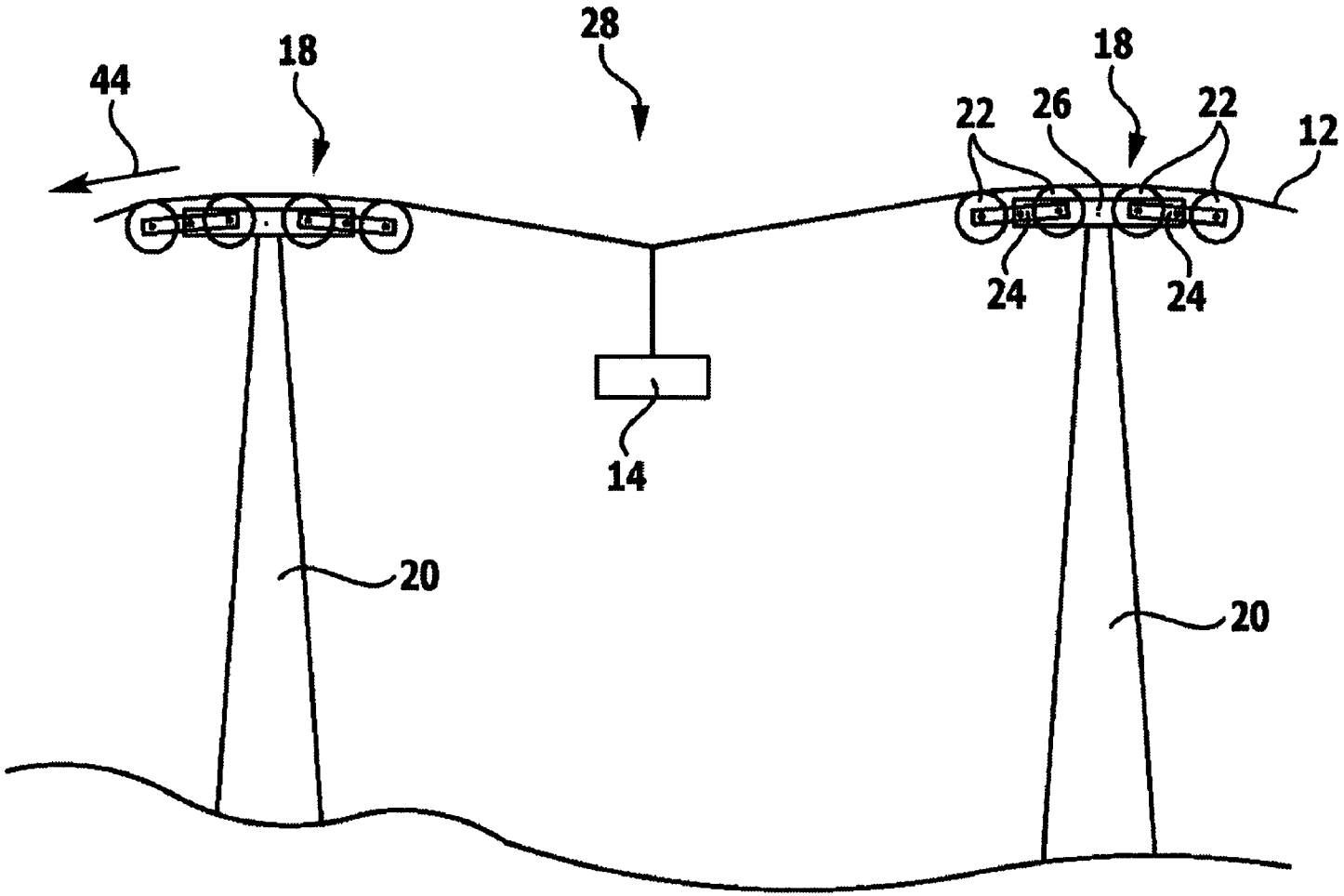
FIG. 1: shows a schematic illustration of two supports and roller assemblies of an aerial cableway under a light load.

In the Figures, there is illustrated, at least schematically, a cable operated transportation system in the form of an aerial cableway bearing the general reference symbol 10. It comprises a cable 12 on which, for example, chairs or gondolas for the transportation of people or load gondolas 14 for the transport of loads are arranged and firmly connected to the cable 12. A drive device 16 is configured and arranged in such a manner that the cable 12 which is preferably in the form of a closed loop can be moved in order to move the load gondolas 14 along the transportation system 10 in circulating manner.

For the purposes of guiding the cable 12, there are provided roller assemblies 18 which are held on supports 20. The roller assemblies 18 which are also referred to as roller batteries comprise several cable rollers 22. In the exemplary embodiment of a transportation system 10 illustrated in the Figures, each roller assembly 18 comprises four cable rollers 22. In each case, two cable rollers 22 are mounted in rotatable manner on a yoke 24 which is pivotally mounted relative to a cross beam 26 at a free end of the support 20. In dependence on the size of a load imposed on the cable 20 by the load gondolas 14 in a span 28 between two roller assemblies 18, the yokes 24 are inclined relative to the cross beams 26 to a greater or lesser extent. The greater the inclination, the larger the load exerted on the cable 12 by the load gondolas 14 in the span 28, this being illustrated in exemplary manner in FIGS. 1 and 2.

Figure 2:
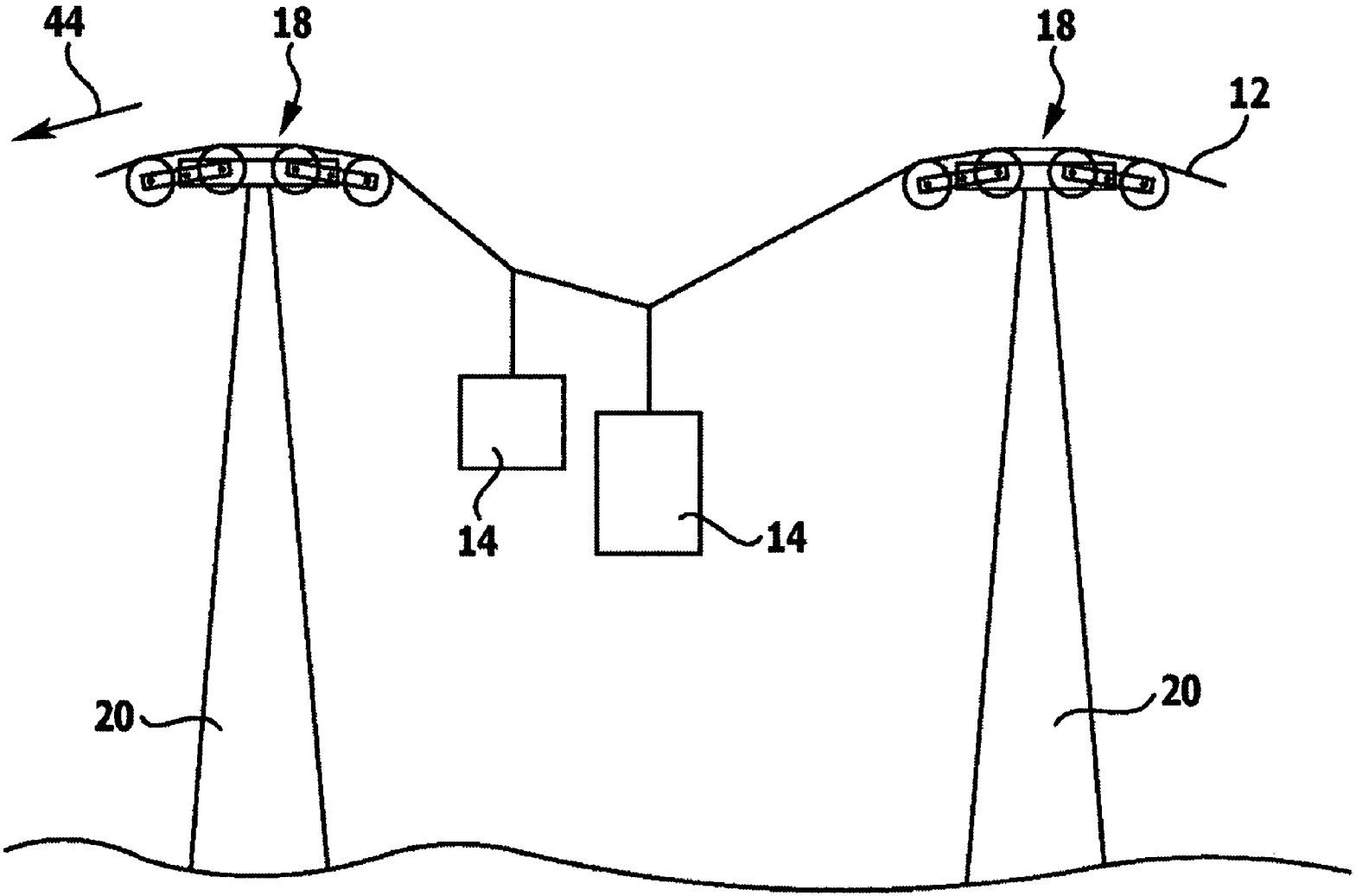
FIG. 2: a schematic illustration of two supports and roller assemblies of an aerial cableway under an increased load.

The roller assemblies 18 can be in the form of supporting roller arrangements, i.e. the cable 12 rests upon the cable rollers 22 of the roller assembly 18 in these roller assemblies 18, as is illustrated in FIGS. 1 and 2. Alternatively, the roller assemblies 18 could also be in the form of holding down roller assemblies, i.e. the cable 12 is held down by the roller assembly 18 and presses against the rollers 22 in a direction opposed to the force of gravity. For example, the schematic illustration in FIG. 3 corresponds to a view of a roller assembly 18 in the form of a holding down roller assembly from below.

The cable rollers 22 are provided with a peripheral radially outwardly open cable guide groove 30 in the form of a guide slot which defines a cross section in the form of a segment of a circular arc. If external transverse forces are not effective on the cable 12, then the cable 12 lies in the cable guide groove 30 such as to be symmetrical with respect to a centre plane that is perpendicular relative to an axis of rotation 32 about which the cable roller 22 is mounted in rotatable manner. An effective radius of the cable roller 22 is then defined by the distance r between the axis of rotation 32 and a tangent 34 to the cable guide groove 30 which is parallel to the axis of rotation 32.

Figure 3:
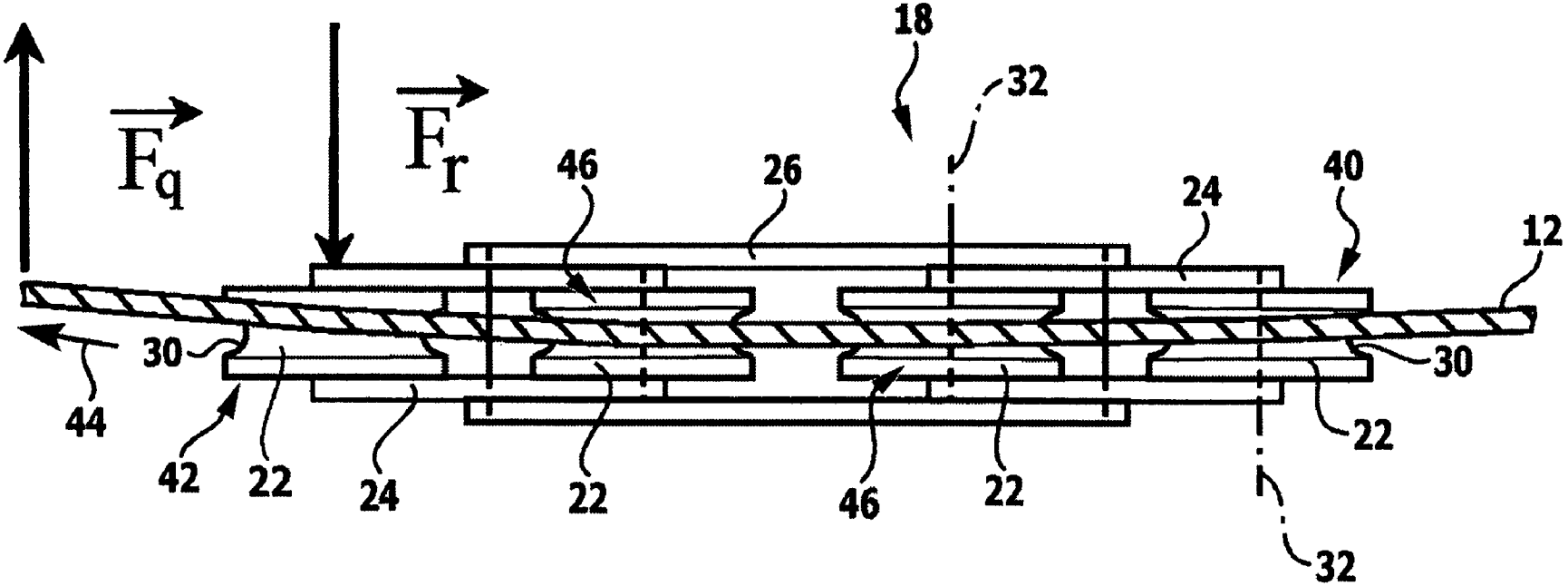
FIG. 3: a plan view of a roller assembly with transverse forces effective on the cable.
Figure 4:
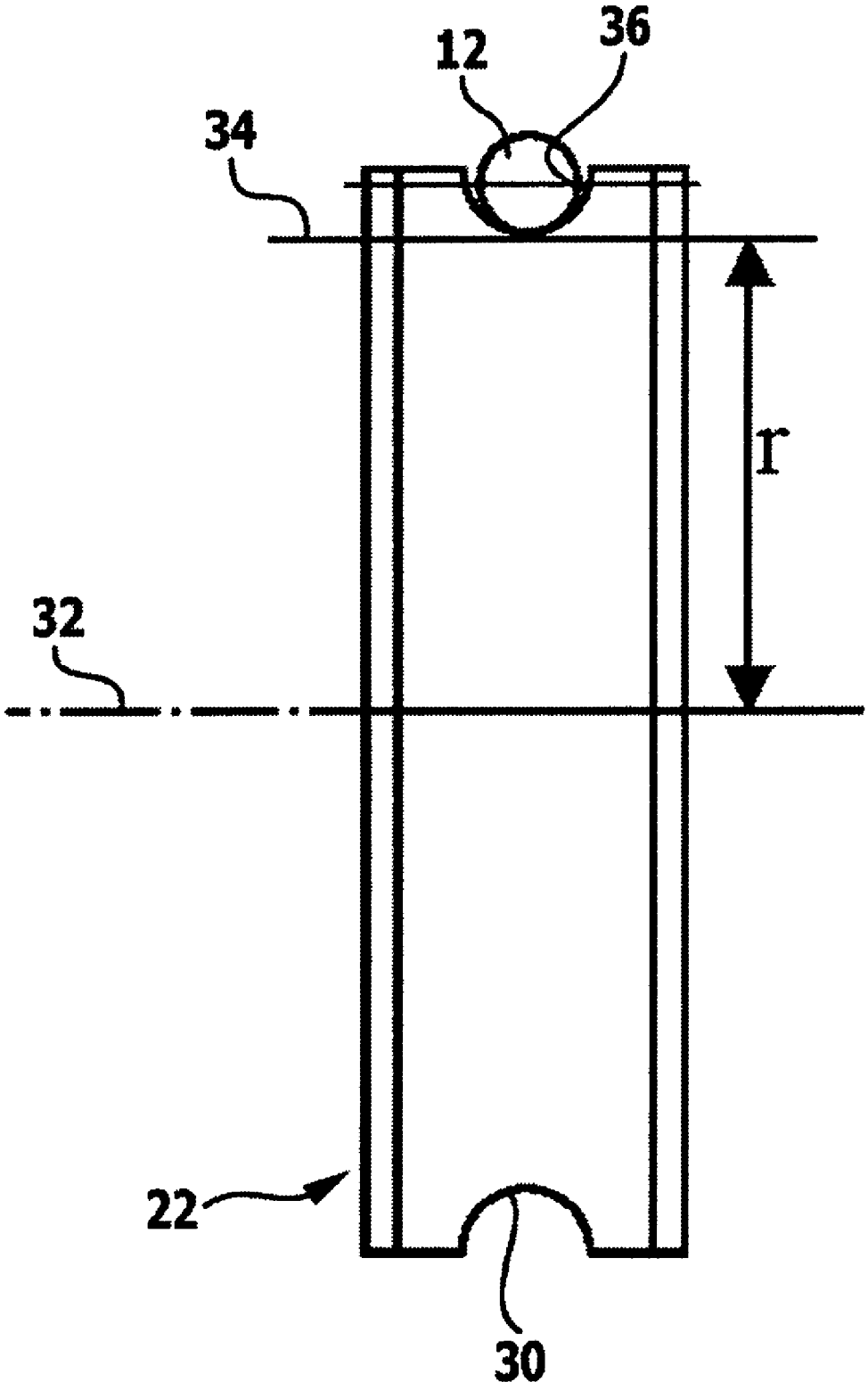
FIG. 4: a sectional view through a cable roller without transverse forces effective on a cable being guided therein.
Figure 5:
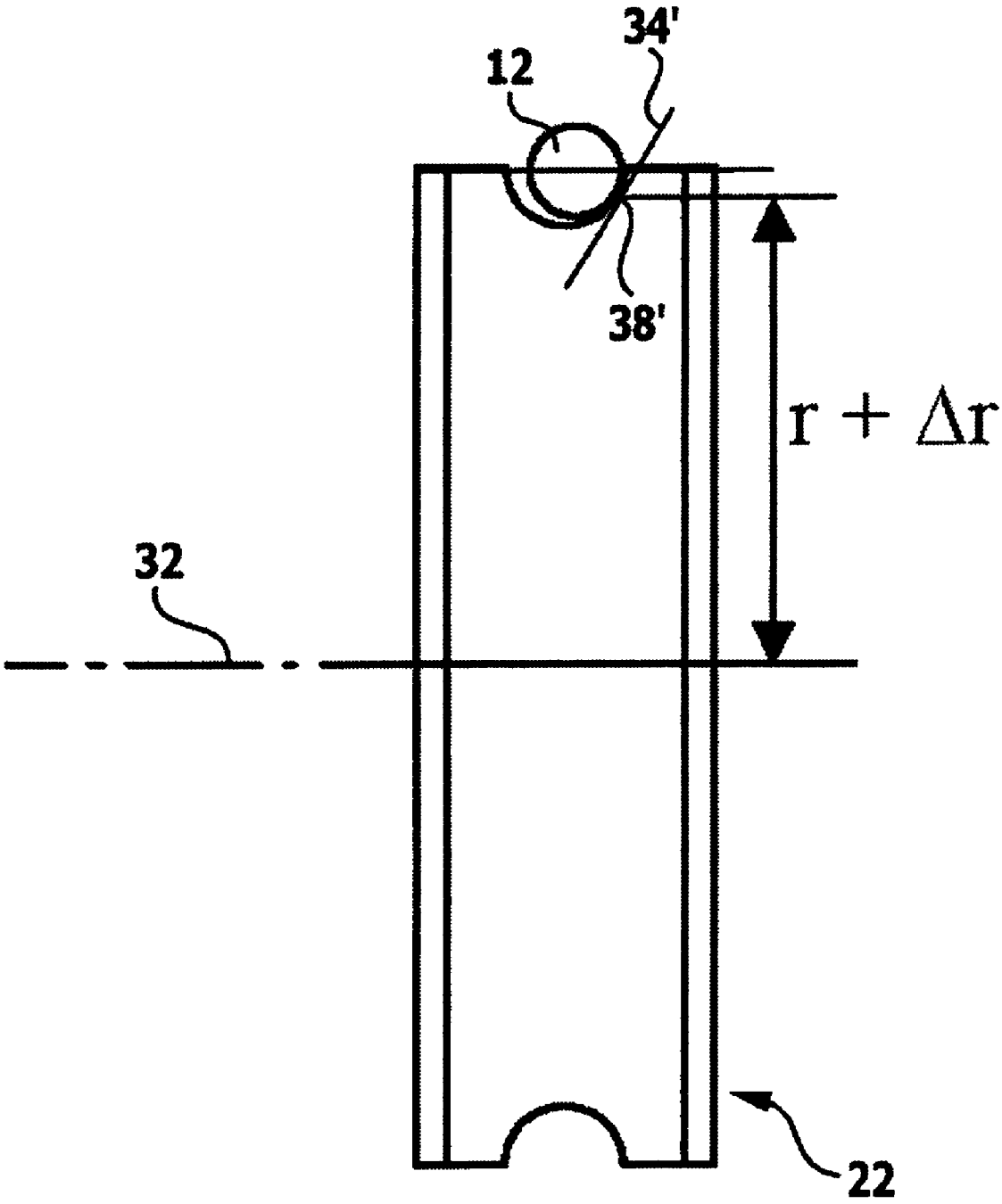
FIG. 5: a sectional view analogous to FIG. 4, but with a transverse force effective on the cable.
Figure 6:
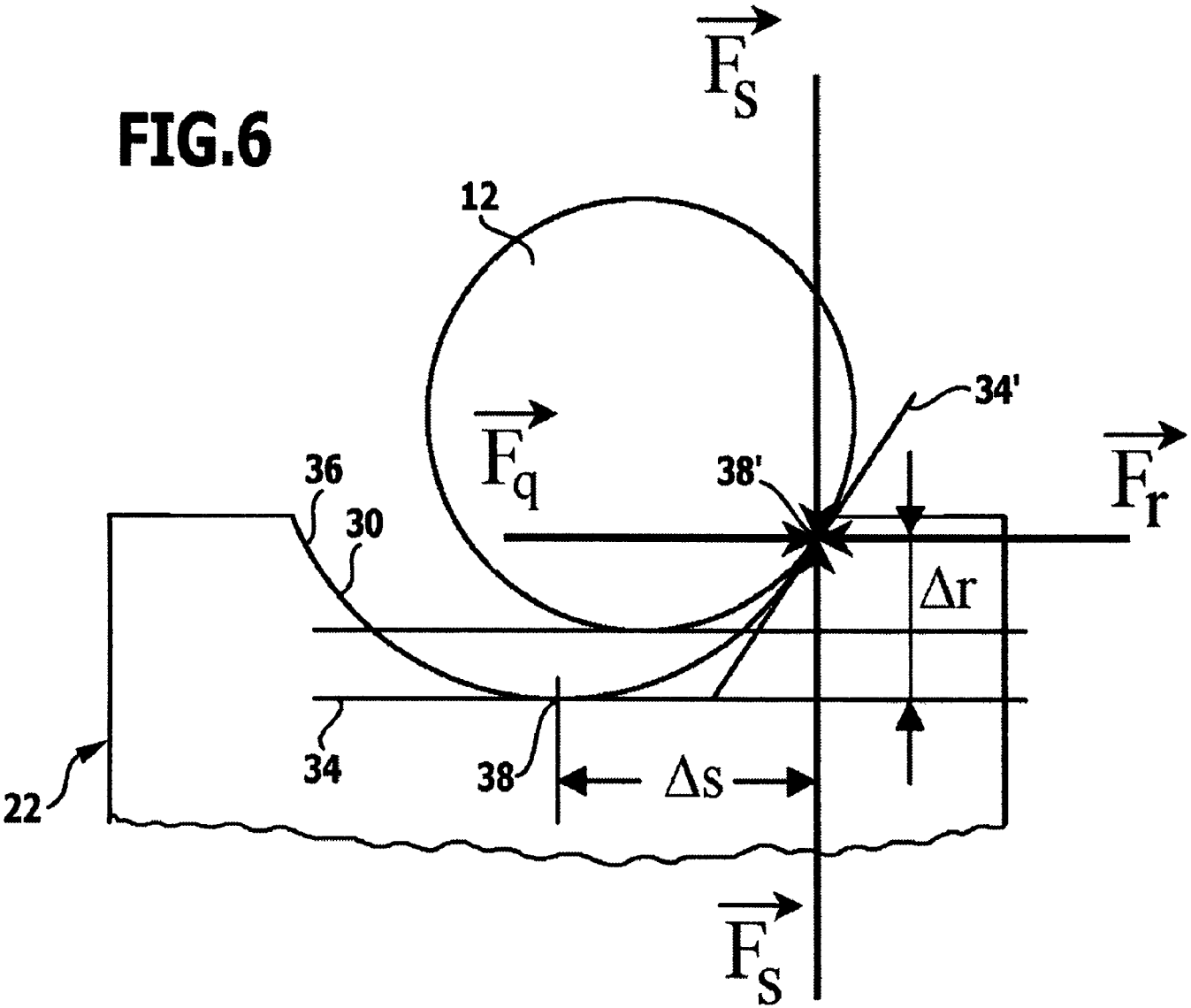
FIG. 6: an enlarged view of a detail in FIG. 5.

Due to the wind, particularly in a storm, as well as to the swaying of the load gondolas 14, transverse forces $F_q$ such as are illustrated in FIG. 3 occur and these can deflect the cable from the rest position described and illustrated in FIG. 4. A deflection of the cable 12 from its rest position manifests itself essentially in that the cable 12 is pushed up laterally onto an inner surface 36 of the cable guide groove 30 so that the distance of the cable 12 from the axis of rotation 32 changes. An effective radius r+Δr of the cable 12 in the deflected state is defined by the distance between a point 38' where the cable 12 touches the inner surface 36 of the cable guide groove 30 from the axis of rotation 32. This touching point 38' is defined by a tangent 34' to the cable guide groove 30. The larger the transverse force $F_q$ effective on the cable 12, the further the cable 12 is deflected from the rest position. In the worst case, the cable 12 withdraws completely from the cable guide groove 30, and jumps off the cable roller 22. The danger of such a cable dislodgement becomes the greater, the larger the transverse forces $F_q$ effective on the cable 12. The position of the cable 12 in the cable guide groove 30 is determined on the one hand by the transverse force $F_q$ and the restoring force $F_r$ applied by the cable roller 22. In dependence in each case on the effective transverse force $F_q$, an equilibrium sets in and thus there is an effective radius r+Δr, such is as exemplarily illustrated in FIGS. 3 to 6.

The largest deflection of the cable 12 from the rest position is apparent at the cable rollers 22 defining the run-in rollers 40 and the run-out rollers 42. The run-in roller 40 is defined by the cable roller 22 onto which the cable 12 runs in from the span 28 in the direction of movement 44, the run-out roller 42 is defined by the cable roller 22 from which the cable 12 runs into the span 28 in the direction of movement 44. Common to the run-in roller 40 and the run-out roller 42 of the roller assembly 18 is that neighbouring them, there is arranged just one further cable roller 22 in each case. The two other cable rollers 22 of the roller assembly 18 form so-called inner rollers which are also referred to hereinafter as reference rollers 46. Inner rollers are defined in such a way that they are arranged between two neighbouring cable rollers 22, in the present exemplary embodiment of the roller assembly 18, between the run-in roller 40 and a cable roller 22 or between a cable roller 22 and the run-out roller 42.

Due to the occurrence of transverse forces $F_q$, a deflection of the cable 12 is largest in the cable guide groove 30 of the run-in roller 40 or the run-out roller 42. The reason for this is that in each case there is only one further neighbouring cable roller 22 additionally contributing to the application of a restoring force $F_r$. A deflection of the cable 12 within the region of the reference rollers 46 is significantly smaller compared with the run-in roller 40 and the run-out roller 42 since in each case, in addition to the reference roller 46, the neighbouring cable rollers 22 apply restoring forces $F_r$ which work against the transverse forces $F_q$.

For the purposes of determining the safe-to-operate status of the transportation system 10, there is provided a cable position monitoring device bearing the general reference symbol 48. It comprises at least one movement-magnitude detecting device 50 which is associated with two cable rollers 22. In the present exemplary embodiment, two movement-magnitude detecting devices 50 are provided which are respectively associated with a cable roller 22 of the roller assembly 18. Preferably, a movement-magnitude detecting device 50 is associated with one of the two reference rollers 46, a further movement-magnitude detecting device 50 with the run-in roller 40 and/or the run-out roller 42.

Figure 7:
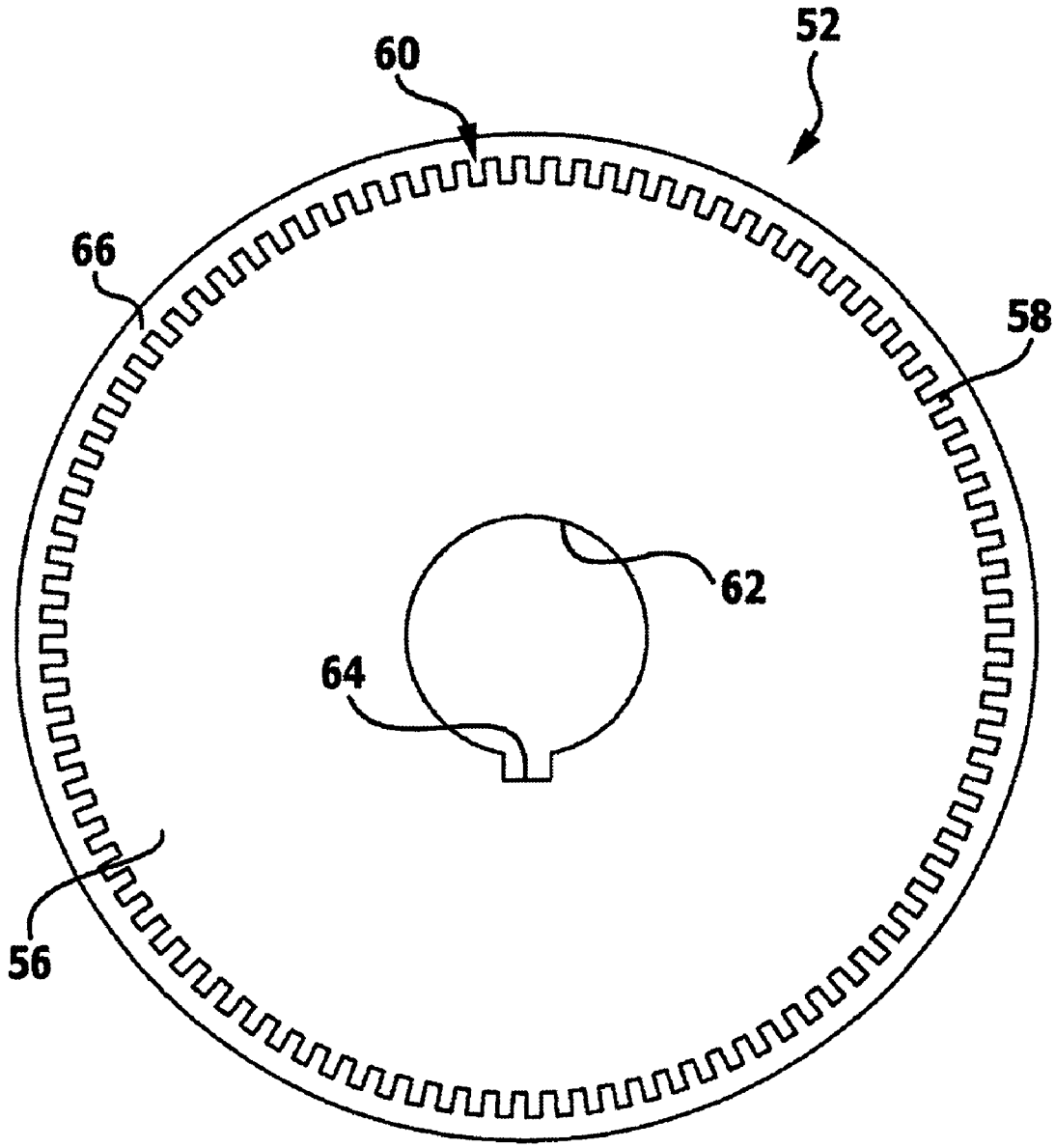
FIG. 7: a sectional view of a timing disc.

The movement-magnitude detecting device 50 comprises a clock pulse generating member 52 which is connected in mutually non-rotational manner to the respective cable roller 22 and is in the form of a timing disc as well as a sensor 54, for example, a capacitive or inductive proximity sensor with which a rotational movement of the clock pulse generating member 52 can be detected. The timing disc is in the form of a flat metallic annulus 56 which is provided at the outer edge thereof with toothing 60 comprising a plurality of clock members in the form of projections forming teeth 58. The annulus 56 that is illustrated schematically in FIG. 7 for example is provided with a central circular through hole 62 in which there is provided a recess 64 of square cross section that points in the direction of the centre of the break-through and in which a corresponding not illustrated projection of a bearing shaft for the respective cable roller 22 engages so that the clock pulse generating member 52 rotates at the same rotational speed as the associated cable roller 22.

The annulus 56 provided with the toothing 60 is provided with an anti-icing layer 66 in the form of a coating of synthetic material which prevents the possibility of ice forming on the clock pulse generating member 52.

Figure 8:
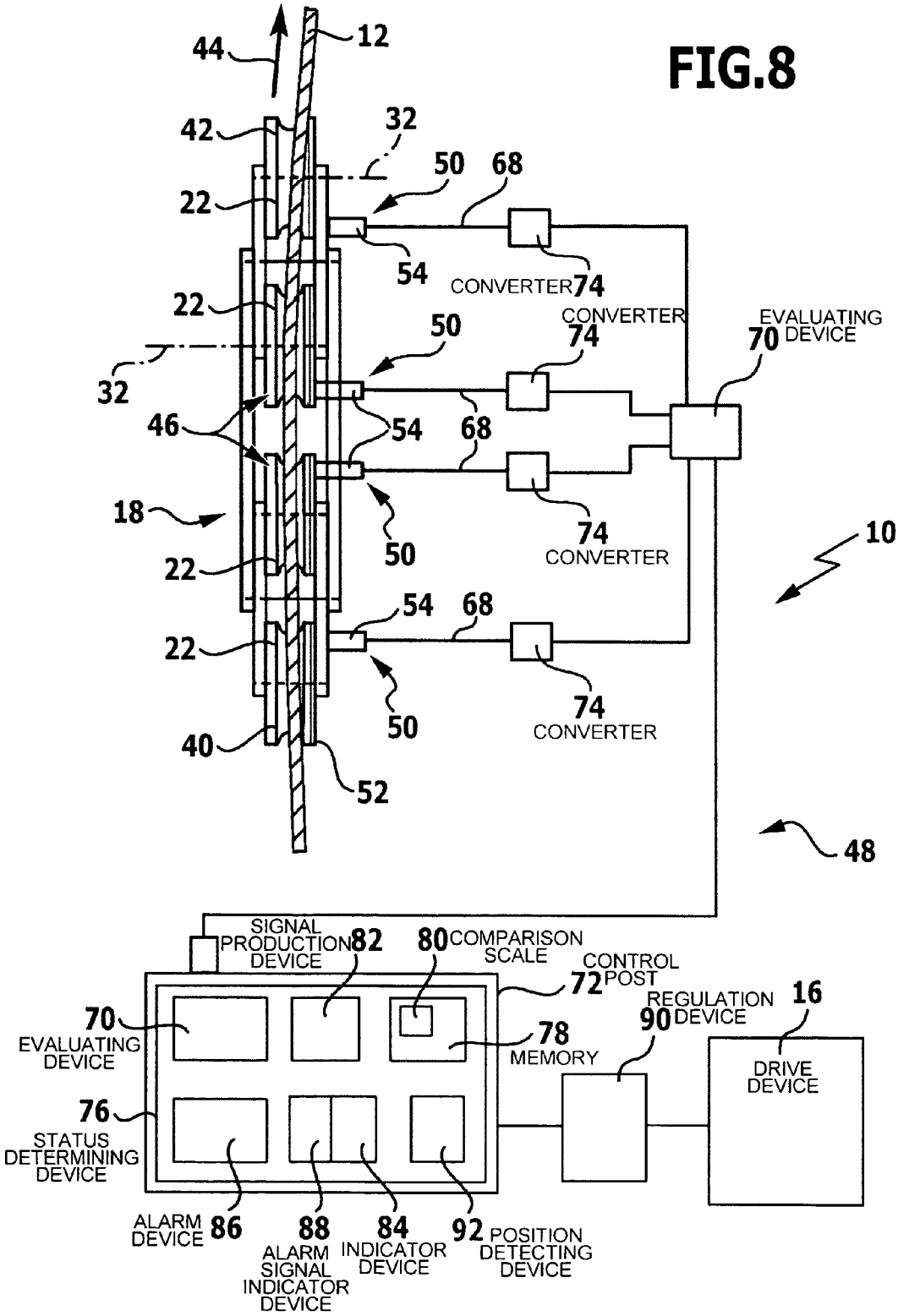
FIG. 8: a schematic illustration of a cable position monitoring device in a cable operated transportation system.

The sensors 54 are attached to the roller assembly 18 in such a manner that they can detect a movement of the teeth 58. They produce a clock pulse signal which is supplied over signal lines 68 to an evaluating device 70. The evaluating device 70 can be arranged in the region of the roller assembly 18, on the support 20 for example. Optionally, as illustrated exemplarily in FIG. 8, the evaluating device 70 can also be arranged in the region of a control post 72 of the transportation system 10. Optionally, a converter unit 74 can be connected-in between the sensor 54 and the evaluating device 70, said converter unit serving to convert the signal produced by the sensor 54 into a rotational speed signal and supply it to the evaluating device 70.

A movement-magnitude of the respective cable roller 22, a rotational speed or an angular speed for example, can be determined by the movement-magnitude detecting device 50. The movement-magnitude detecting device then forms either a rotational speed detecting device or an angular speed detecting device. The evaluating device 70 is configured in such a manner that the determined movement-magnitudes can be compared therewith, and, for example, a difference therebetween can then be determined. For example, a difference between the sensor signal which with [sic] the sensor 54 that is associated with the run-in roller 40 or the run-out roller 42 can be compared with the sensor signal from the sensor 54 that is associated with one of the reference rollers 46, and a movement-magnitude deviation can be determined, a rotational speed difference for example. A deflection of the cable 12 from its rest position in a cable roller 22, the run-in roller 40 or the run-out roller 42 for example, can be determined from the determined rotational speed difference between the two monitored cable rollers. This is possible for reason that the cable 12 is being moved at a constant speed relative to the two cable rollers 22, whereby however, the respective effective radii r and r+Δr of the two cable rollers 22 are different in the event of transverse forces. Hence, it follows that a rotational speed of the run-in roller 40 or the run-out roller 42 is smaller than a rotational speed of the reference roller 22. The greater the difference Δr of the respective effective radii r and r+Δr, the larger the deflection of the cable 12 from the rest position of the monitored cable roller 22. As a consequence thereof, the danger of a cable dislodgement is also then greater, the bigger the deviation in the movement-magnitudes, thus for example, a difference in rotational speed between the run-in roller 40 or the run-out roller 42 and one of the reference rollers 42.

For example, there is provided in the control post 72 the safe-to-operate status determining device 76 which may optionally also comprise the evaluating device 70. The safe-to-operate status of the transportation system 10 can be determined with the aid of the safe-to-operate status determining device 76 in dependence on at least one specific movement-magnitude deviation. To this end, a comparison scale 80 is preferably integrated in a memory 78 of the safe-to-operate status determining device 76. The comparison scale 80 serves for the assignment of a value for the safe-to-operate status to a determined value of a movement-magnitude deviation. For this purpose, there serves the safe-to-operate status signal production device 82 with the aid of which the safe-to-operate status signal is produced that corresponds to a value of the safe-to-operate status on the comparison scale that is assigned to the specific movement-magnitude deviations.

An indicator device 84 serves for the optical and/or acoustic indication of the safe-to-operate status signal. The indicator device 84 can be in the form of a monitor and/or a loudspeaker for example.

Furthermore, the safe-to-operate status determining device 76 comprises an alarm device 86 for producing an alarm or a shut-down signal if a value of the safe-to-operate status signal exceeds a given limiting value which can be stored in the memory 78 for example. Furthermore, an alarm signal indicator device 88 can be provided for the indication of the alarm signal. In particular, this could also form a unit with the indicator device 84. The alarm signal indicator device 88 serves for indicating the pertinent alarm and/or shut-down signal optically and/or acoustically.

The alarm and/or shut-down signal can be passed on by the safe-to-operate status determining device 76 to a control and/or regulation device 90 of the transportation system 10 which takes appropriate action on the drive device 16 of the transportation system 10 in dependence on the value of the alarm and/or shut-down signal, for example, in that the speed of the cable 12 is reduced, or the drive device 16 is switched off, or the transportation system 10 is completely shut-down in order to prevent a dislodgement of the cable.

Furthermore, the safe-to-operate status determining device 76 may comprise a cable position detecting device 92 for determining the position of the cable 12 on the at least one first cable roller 22. The cable position detecting device 92 can be configured, in particular, in such a manner that a deflection of the cable 12, which has been forced thereon by effective transverse forces $F_q$, in the at least one first cable roller 22 from the rest position in which no transverse forces $F_q$ are effective on the cable 12 is determinable from the deviation in the movement-magnitudes that has been determined. Furthermore, the safe-to-operate status determining device 76 is preferably configured in such a manner that the position of the cable 12 in the at least one first cable roller 22 that has been determined by the cable position detecting device 92 is associable with the safe-to-operate status of the transportation system 10.

Furthermore, the movement-magnitude detecting devices 50 are configured in such a manner that the movement-magnitudes of the cable rollers 22 with which they are associated can be detected therewith at preferably the same time. Optionally, the safe-to-operate status signal production device 82 can be configured in such a manner that the first and second movement-magnitudes are determinable in time dependent manner by the movement-magnitude detecting devices 50, and that the evaluating device 70 is configured in such a manner that an average deviation of the first movement-magnitude from the second movement-magnitude is determinable over a given time interval. In principle, this time interval can be freely selected by the operator of the transportation system 10. For example, the time interval can be selected to be within a range of 0.5 seconds to 5 seconds. By determining the average deviation of operational magnitudes over a certain time interval, fluctuations having a negligible effect on a possible cable dislodgement can be averaged out so that an unnecessary reduction in speed or shut-down of the transportation system 10 can be avoided.

The safe-to-operate status device 76 may, in particular, also comprise a data-processing system, in the form of a computer for example, which incorporates the functions of the evaluating device 70, the safe-to-operate status signal production device 82, the alarm signal production device 88 as well as the cable position detection device 92. An appropriate input device, a keyboard for example, can be provided for entering data. Furthermore, the data-processing system can be configured in such a manner that it is suitable for allowing a computer program to be run in order to implement one of the methods described above for monitoring the position of a cable 12 guided in the rollers 22 of a roller assembly 18, or a method as is claimed in the corresponding method Claims. The computer program can, in particular, be stored on a computer-readable medium and comprise program code means which are suitable for implementing one of the methods described above or one of the claimed methods when the computer program is run on the data-processing system of the cable position monitoring device 48. The computer-readable medium can, for example, be in the form of a data carrier, for example, in the form of a CD ROM, a diskette or a memory card.

Figure 9:
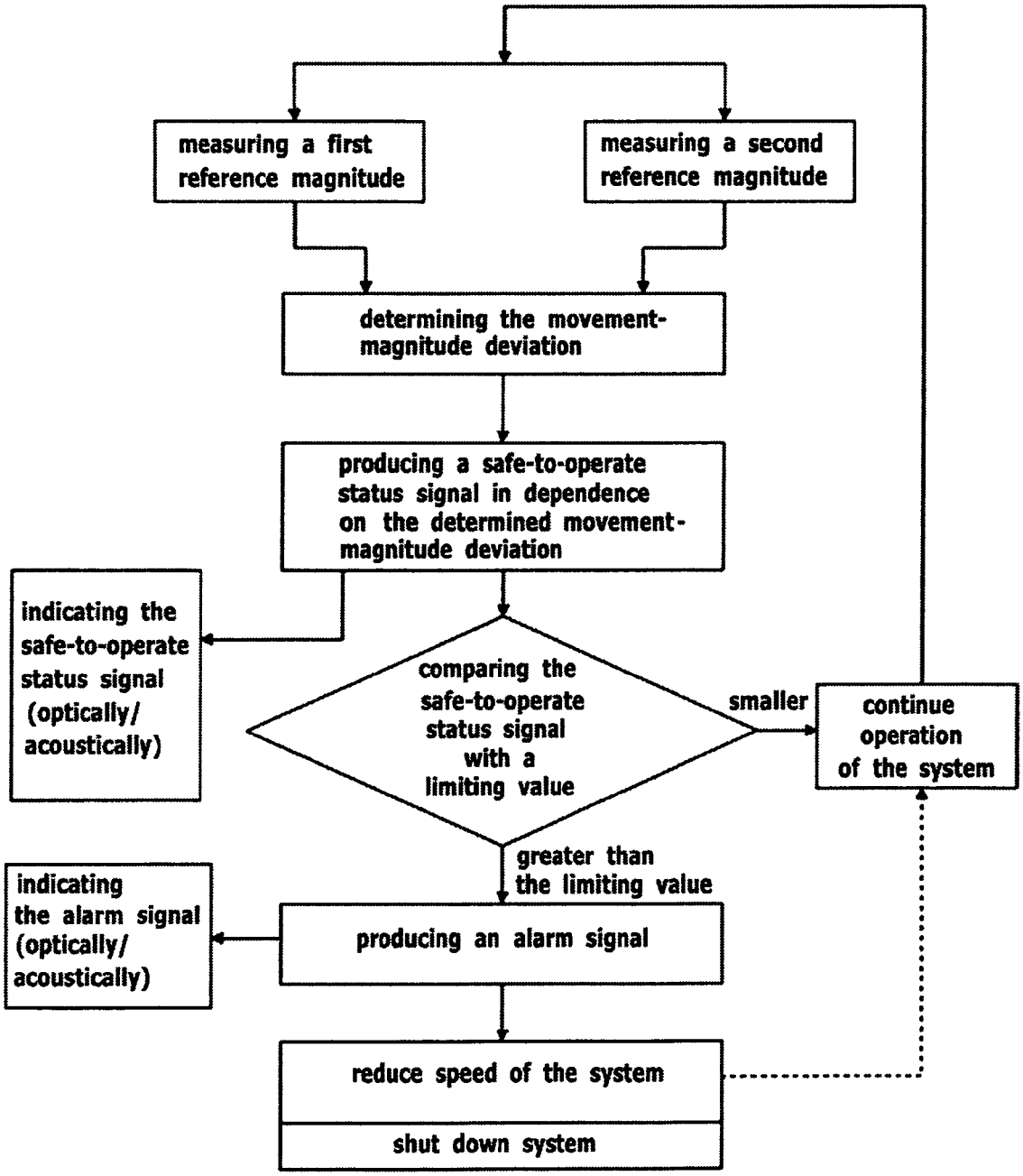
FIG. 9: a flow chart of a method for monitoring the cable position in a cable operated transportation system.

An example of a possible operational sequence for determining the safe-to-operate status is illustrated schematically in FIG. 9.

After the transportation system 10 has been started, at least a first movement-magnitude, the rotational speed of the run-in roller 40 or the run-out roller 42 for example, is determined with the aid of the movement-magnitude detecting devices 50. Furthermore, a second movement-magnitude, the rotational speed of a reference roller 46 for example, is determined with the aid of a further movement-magnitude detecting device 50. It is preferable that the first and second movement-magnitudes be measured at the same time. The movement-magnitude deviation between the first and second movement-magnitudes is determined with the aid of the evaluating device 70.

In a next step, the safe-to-operate status signal is produced in dependence on the movement-magnitude deviation that has just been determined. Optionally, the safe-to-operate status signal can be indicated optically and/or acoustically with the aid of the indicator device 84. This, for example, can done in such a manner that a text message, which indicates the safe-to-operate status "no disturbance" or "great danger of a cable dislodgement" for example, is displayed on a monitor. Self-evidently, the indicator device could also display the safe-to-operate status signal in the form of a bar chart display which, additionally, could be coloured. For example, a green indication is present in the case of the safe-to-operate status wherein there is no disturbance, a yellow indication where there is a minimum danger of cable dislodgement and a red indication where there is a great danger of a cable dislodgement. The safe-to-operate status signal is produced with the help of the comparison scale on the basis of the measured movement-magnitude deviation by an appropriate allocation process.

In order to influence the operation of the transportation system 10, the safe-to-operate status signal is compared with a limiting value that has been set in advance. If the safe-to-operate status signal is smaller than the limiting value, then operation of the system continues unaltered, i.e. the first and second movement-magnitudes continue to be measured as described above.

However, if the comparison of the safe-to-operate status signal with the limiting value shows that the limiting value has been exceeded, then an alarm signal is preferably produced by the alarm device and this is indicated optically and/or acoustically with the aid of the alarm signal indicator device 88 for example. The indication can, in particular, comprise a full text message including information such as "reduce speed" or "switch off drive device" or "shut down the system" for example. Depending on the extent to which the limiting value was exceeded, either the speed of the system can be reduced until the safe-to-operate status signal sinks back below the limiting value whereupon the system can then continue to be operated at the originally desired speed, or the system can be immediately shut down automatically in order to prevent a cable dislodgement at the monitored cable roller 22.

The first movement-magnitude and the second movement-magnitude do not necessarily have to be determined at the same roller assembly 18. It is also possible to provide just one reference roller 46 for the entire transportation system 10 and otherwise monitor the other cable rollers 22, and to determine a movement-magnitude of these other first cable rollers with the aid of a movement-magnitude detecting device 50. However, as the cable 12 is not pulled continuously over a roller assembly 18 but the dip in the span 28 can change in load dependent manner, this frequently leads to a discontinuity in the cable speed at different roller assemblies 18. If, for the purposes of monitoring a cable roller 22, a reference roller 46 in the same roller assembly 18 is selected, then speed components caused because of fluctuations in the load or varying cable accelerations can be compensated with the help of this determination of the movement-magnitude deviation.

Alternatively, encapsulated incremental or absolute position measuring systems can also be employed as movement-magnitude detecting devices 50.

If the individual measured movement-magnitudes are fed to the evaluating device 70 in the control post 72, then transmission and measuring errors can be detected by a correlation of the individual measured values at each roller assembly 18 or at different roller assemblies 18. If inadmissible differences should thereby arise, then this may, for example, relate to a loss of the entire cable position monitoring device 48 or to the break-down of parts of the cable position monitoring device 48 or to a cable dislodgement. In each case, safe operation of the transportation system 10 can be guaranteed due to these redundantly determined measured values.

Preferably, movement-magnitude detecting devices 50 of different design and transmission mode are used in order not to generate systematic errors in the operation of the cable position monitoring device 48.

The cable position monitoring device 48 described here has the great advantage that it is completely independent of the cable structure. A so-called cable lay or the manner in which the cable is constructed, a rolled or a non-rolled cable for example, have no effect on the determination of the safe-to-operate status.

Moreover, the state of wear of the cable rollers 22 can also be determined automatically with the aid of the cable position monitoring device 48 by means of corresponding movement-magnitude comparisons per measured run of the cable 12. Wear within a roller assembly 18 can be determined in a short-term comparison, wear of the cable rollers 22 in different roller assemblies 18 is possible using a long-term comparison. In particular, it is also possible to mutually compare the movement-magnitudes of any desired cable rollers 22 that are to be monitored with the aid of the evaluating device 70 and, in this way, detect a differing degree of wear of the cable rollers 22 by averaging over a certain time interval.

The invention claimed is:

1. A cable position monitoring system for monitoring a position of a cable guided in rollers of a roller assembly, at least a first cable roller that is to be monitored in the roller assembly of a cable operated transportation system comprising at least one first and at least one second cable roller defining a reference roller, said system comprising:

a movement-magnitude detecting device for determining a first movement-magnitude of the at least one first cable roller and a second movement-magnitude of the reference roller, and an evaluating device for comparing the first and second movement-magnitudes and for determining a mutual movement-magnitude deviation between the first and second movement-magnitudes which corresponds to a safe-to-operate status of the transportation system.

2. A cable position monitoring system in accordance with claim 1, further comprising a safe-to-operate status determining device for determining the safe-to-operate status of the transportation system in dependence on at least one ascertained movement-magnitude deviation.

3. A cable position monitoring system in accordance with claim 2, further comprising a cable position detection device for determining a position of the cable in the at least one first cable roller.

4. A cable position monitoring system in accordance with claim 3, wherein the cable position detecting device is configured in such a manner that a deflection of the cable in the at least one first cable roller from a rest position in which no transverse forces ($F_q$) are effective on the cable is determinable from the at least one ascertained movement-magnitude deviation.

5. A cable position monitoring system in accordance with claim 3, wherein the safe-to-operate status determining device is configured in such a manner that a safe-to-operate status of the transportation system is associated with a position of the cable in the at least one first cable roller determined by the cable position detecting device.

6. A cable position monitoring system in accordance with claim 1, wherein the evaluating device is configured in such a manner that a movement-magnitude deviation for at least two first cable rollers is determinable by a comparison of respective first movement-magnitudes of the at least two first cable rollers and the second movement-magnitude of the reference roller.

7. A cable position monitoring system in accordance with claim 2, further comprising:

a comparison scale for the safe-to-operate status, and a safe-to-operate status signal production device for producing a safe-to-operate status signal which corresponds to a value of the safe-to-operate status on the comparison scale that is associated with the at least one ascertained movement-magnitude deviation.

8. A cable position monitoring system in accordance with claim 1, further comprising:

a comparison scale for the safe-to-operate status, and a safe-to-operate status signal production device for producing a safe-to-operate status signal which corresponds to a value of the safe-to-operate status on the comparison scale that is associated with a deflection of the cable in the at least one first cable roller from a rest position.

9. A cable position monitoring system in accordance with claim 7, wherein the safe-to-operate status signal production device is configured in such a manner that ascertained movement-magnitude deviations from at least two first cable rollers are processable for the production of the safe-to-operate status signal.

10. A cable position monitoring system in accordance with claim 7, wherein the safe-to-operate status signal production device comprises a maximum value determination unit with which a maximum value of at least two movement-magnitude deviations is determinable.

11. A cable position monitoring system in accordance with claim 7, further comprising at least one of an optical indicator device and an acoustic indicator device for indicating the safe-to-operate status signal.

12. A cable position monitoring system in accordance with claim 7, further comprising an alarm device for producing at least one of an alarm and a shut-down signal if a value of the safe-to-operate status signal exceeds a given limiting value.

13. A cable position monitoring system in accordance with claim 12, further comprising at least one of an optical indicator device and an acoustic alarm signal indicator device for indicating the at least one of the alarm and shut-down signal.

14. A cable position monitoring system in accordance with claim 12, wherein:

the alarm device cooperates with at least one of a control device and a regulation device of a drive device of the transportation system, and the alarm device is configured in such a manner that at least one of a drive speed of the transportation system can be reduced and the drive device of the transportation system can be switched off as a result of the production of the at least one of the alarm and the shut-down signal.

15. A cable position monitoring system in accordance with claim 1, wherein the movement-magnitude detecting device is configured in such a manner that the first and second movement-magnitudes are determinable simultaneously.

16. A cable position monitoring system in accordance with claim 1, wherein:

the movement-magnitude detecting device is configured in such a manner that the first and second movement-magnitudes are determinable in a time dependent manner, and the evaluating device is configured in such a manner that an average deviation of the first movement-magnitude from the second movement-magnitude is determinable over a given time interval.

17. A cable position monitoring system in accordance with claim 1, wherein the movement-magnitude detecting device is configured such that at least one of the first and second movement-magnitude is determined in a non-contact making manner.

18. A cable position monitoring system in accordance with claim 1, wherein the movement-magnitude detecting device is in a form of a rotational speed detecting device or an angular speed detecting device.

19. A cable position monitoring system in accordance with claim 18, wherein the rotational speed or the angular speed detecting device comprises a clock pulse generating member which is connectable in a mutually non-rotational manner to the cable roller the movement-magnitude of which is to be determined, and at least one sensor for detecting a rotation of the clock pulse generating member.

20. A cable position monitoring system in accordance with claim 19, wherein the clock pulse generating member is in a form of a timing disc having a multiplicity of clock members arranged regularly around a periphery of the timing disc.

21. A cable position monitoring system in accordance with claim 20, wherein the clock members are in a form of radially outwardly or axially protruding projections which form a regular tooth-set.

22. A cable position monitoring system in accordance with claim 19, wherein the clock pulse generating member is made at least partly of a metal.

23. A cable position monitoring system in accordance with claim 19, wherein the clock pulse generating member is provided with an anti-icing layer.

24. A cable position monitoring system in accordance with claim 23, wherein the anti-icing layer is made of a synthetic material.

25. A cable position monitoring system in accordance with claim 19, wherein the sensor is an inductive or capacitive proximity sensor.

26. A cable position monitoring system in accordance with claim 1, wherein the movement-magnitude detecting device is configured in such a manner that a movement-magnitude of at least one of a run-in roller and a run-out roller of the roller assembly, which forms the at least one first cable roller, is determinable.

27. A cable position monitoring system in accordance with claim 1, wherein the movement-magnitude detecting device is configured in such a manner that a movement-magnitude of an inner cable roller, which is arranged between neighboring cable rollers and forms the reference roller, is determinable.

28. A cable operated transportation system comprising:

a cable, a drive device for moving the cable, and at least one roller assembly for guiding the cable, the at least one roller assembly comprising at least one first cable roller and at least one second cable roller defining a reference roller, a cable position monitoring system for monitoring at least a position of the cable guided in the at least one first cable roller, said cable position monitoring system comprising:

a movement-magnitude detecting device for determining a first movement-magnitude of the at least one first cable roller and a second movement-magnitude of the reference roller, and an evaluating device for comparing the first and second movement-magnitudes and for determining a mutual movement-magnitude deviation between the first and second movement-magnitudes which corresponds to a safe-to-operate status of the transportation system.

29. A cable operated transportation system in accordance with claim 28, wherein the cable position monitoring system further comprises a safe-to-operate status determining device for determining the safe-to-operate status of the transportation system in dependence on at least one ascertained movement-magnitude deviation.

30. A cable operated transportation system in accordance with claim 28, wherein the cable is at least one of a carrier-, traction- and hoisting cable.

31. A cable operated transportation system in accordance with claim 28, wherein:

a plurality of roller assemblies are provided, and a common cable position monitoring device is respectively associated with at least two of the roller assemblies.

32. A method for monitoring the position of a cable guided in rollers of a roller assembly, at least one first cable roller that is to be monitored of the roller assembly of a cable operated transportation system comprising at least one first and at least one second cable roller defining a reference roller, comprising:

determining a first movement-magnitude of the at least one first cable roller and a second movement-magnitude of the reference roller, comparing the first movement-magnitude of the at least one first cable roller and the second movement-magnitude of the reference roller, and determining a mutual movement-magnitude deviation between the first and the second movement-magnitudes, which corresponds to a safe-to-operate status of the transportation system.

33. A method in accordance with claim 32, wherein:

a position of the cable in the at least one first cable roller is determined from the determined movement-magnitude deviation, and the safe-to-operate status of the transportation system is associated with the position of the cable in the at least one first cable roller.

34. A method in accordance with claim 32, wherein a deflection of the cable in the at least one first cable roller from a rest position in which no transverse forces are effective on the cable is determined from the determined movement-magnitude deviation.

35. A method in accordance with claim 32, wherein the movement-magnitude deviation for at least two first cable rollers is determined by comparing the first movement-magnitude of the at least two first cable rollers and the second movement-magnitude of the reference roller.

36. A method in accordance with claim 35, wherein:

the movement-magnitude deviation is compared with a comparison scale for the safe-to-operate status, and a safe-to-operate status signal corresponding to the movement-magnitude deviation is produced, said signal corresponding to an assigned value of the safe-to-operate on the comparison scale.

37. A method in accordance with claim 35, wherein:

the deflection of the cable in the at least one first cable roller from the rest position is compared with a comparison scale for the safe-to-operate status, and a safe-to-operate status signal corresponding to the movement-magnitude deviation is produced, said signal corresponding to an assigned value of the safe-to-operate status on the comparison scale.

38. A method in accordance with claim 36, wherein ascertained movement-magnitude deviations from at least two first cable rollers are processed in the course of producing the safe-to-operate status signal.

39. A method in accordance with claim 38, wherein a value of the safe-to-operate status signal corresponds to a larger of the determined movement-magnitude deviations which are determined for at least two first cable rollers by comparing the first movement-magnitude of the at least two first cable rollers and the second movement-magnitude of the reference roller.

40. A method in accordance with claim 36, wherein the safe-to-operate status signal is indicated at least one of optically and acoustically.

41. A method in accordance with claim 36, wherein at least one of an alarm and a shut-down signal is produced if a value of the safe-to-operate status signal exceeds a given limiting value.

42. A method in accordance with claim 41, wherein the at least one of the alarm and shut-down signal is indicated at least one of optically and acoustically.

43. A method in accordance with claim 41, wherein at least one of: (i) a drive speed of the transportation system is reduced, (ii) a drive device of the transportation system is switched off, or (iii) the transportation system is shut down as a consequence of the production of the alarm or shut-down signal.

44. A method in accordance with claim 32, wherein the first and the second movement-magnitudes are determined simultaneously.

45. A method in accordance with claim 32, wherein:

the first and the second movement-magnitudes are determined in a time dependent manner, and an average movement-magnitude deviation of the first movement-magnitude from the second movement-magnitude is determined over a given time interval.

46. A method in accordance with claim 32, wherein at least one of the first and the second movement-magnitudes are determined in a non-contact making manner.

47. A method in accordance with claim 32, wherein at least one of the first and the second movement-magnitude is determined in a form of a rotational speed of at least one of the at least one first cable roller and the reference roller.

48. A method in accordance with claim 32, wherein the at least one of the first and the second movement-magnitude is determined in a form of an angular speed of at least one of the at least one first cable roller and the reference roller.

49. A method in accordance with claim 32, wherein the at least one of the first and the second movement-magnitudes are determined using a rotational speed or an angular speed detecting device.

50. A method in accordance with claim 32, wherein at least one of a run-in roller and a run-out roller of the roller assembly which form end cable rollers of the roller assembly are selected as the at least one first cable roller.

51. A method in accordance with claim 32, wherein a cable roller which forms an inner cable roller arranged between two neighboring cable rollers is selected as the reference roller.

52. A method in accordance with claim 32, wherein the transportation system comprises an aerial cableway.

53. A method in accordance with claim 32, wherein the cable comprises at least one of a carrier-, traction- and hoisting cable of a transportation system.

54. A method in accordance with claim 32, wherein rollers comprise a peripheral cable guide groove.

55. A method in accordance with claim 54, wherein the cable guide groove has a cross section defining a portion of a circular arc.

* * * * *